US007819208B2

(12) United States Patent
Pessier et al.

(10) Patent No.: US 7,819,208 B2
(45) Date of Patent: Oct. 26, 2010

(54) DYNAMICALLY STABLE HYBRID DRILL BIT

(75) Inventors: Rudolf Carl Pessier, Galveston, TX (US); Don Q. Nguyen, Houston, TX (US); Michael Steven Damschen, Houston, TX (US); Michael L. Doster, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 46 days.

(21) Appl. No.: 12/179,915

(22) Filed: Jul. 25, 2008

(65) Prior Publication Data

US 2010/0018777 A1 Jan. 28, 2010

(51) Int. Cl.
*E21B 10/14* (2006.01)

(52) U.S. Cl. ..... 175/336; 175/376; 175/431

(58) Field of Classification Search ..... 175/336, 175/376, 431

See application file for complete search history.

(56) References Cited

U.S. PATENT DOCUMENTS

| | | | |
|---|---|---|---|
| 930,759 | A | 8/1909 | Hughes |
| 1,874,066 | A | 8/1932 | Scott et al. |
| 1,879,127 | A | 9/1932 | Schlumpf |
| 1,932,487 | A | 10/1933 | Scott |
| 2,030,722 | A | 2/1936 | Scott |
| 2,198,849 | A | 4/1940 | Waxler |
| 2,297,157 | A | 9/1942 | McClinton |
| 2,719,026 | A | 9/1955 | Boice |
| 3,010,708 | A | 11/1961 | Hlinsky et al. |
| 3,055,443 | A | 9/1962 | Edwards |
| 3,174,564 | A | 3/1965 | Morlan |
| 3,269,469 | A | 8/1966 | Kelly, Jr. |
| 3,424,258 | A | 1/1969 | Nakayama |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |

(Continued)

FOREIGN PATENT DOCUMENTS

| | | |
|---|---|---|
| EP | 0225101 | 6/1987 |

(Continued)

OTHER PUBLICATIONS

International Search Report for corresponding International patent application No. PCT/US2008/083532.

(Continued)

*Primary Examiner*—Giovanna C Wright
(74) *Attorney, Agent, or Firm*—Locke Lord Bissell & Liddell LLP

(57) ABSTRACT

An earth-boring bit comprising a bit body configured at its upper extent for connection into a drillstring. A selected number of fixed blades extend downward from the bit body and a selected number of rolling cutters are mounted for rotation on the bit body. A plurality of rolling-cutter cutting elements are arranged on each rolling cutter and a plurality of fixed-blade cutting elements are arranged on each fixed blade. The selected number of fixed blades exceeds the selected number of rolling cutters by at least one.

21 Claims, 3 Drawing Sheets

U.S. PATENT DOCUMENTS

| | | | | |
|---|---|---|---|---|
| 4,320,808 | A | | 3/1982 | Garrett |
| 4,343,371 | A | | 8/1982 | Baker, III et al. |
| 4,359,112 | A | | 11/1982 | Garner et al. |
| 4,369,849 | A | | 1/1983 | Parrish |
| 4,410,284 | A | | 10/1983 | Herrick |
| 4,444,281 | A | | 4/1984 | Schumacher, Jr. et al. |
| 4,527,637 | A | | 7/1985 | Bodine |
| 4,572,306 | A | | 2/1986 | Dorosz |
| 4,664,705 | A | | 5/1987 | Horton et al. |
| 4,690,228 | A | | 9/1987 | Voelz et al. |
| 4,726,718 | A | | 2/1988 | Meskin et al. |
| 4,727,942 | A | | 3/1988 | Galle et al. |
| 4,738,322 | A | | 4/1988 | Hall et al. |
| 4,765,205 | A | | 8/1988 | Higdon |
| 4,874,047 | A | | 10/1989 | Hixon |
| 4,875,532 | A | | 10/1989 | Langford, Jr. |
| 4,892,159 | A | | 1/1990 | Holster |
| 4,932,484 | A | | 6/1990 | Warren et al. |
| 4,936,398 | A | | 6/1990 | Auty et al. |
| 4,943,488 | A | | 7/1990 | Sung et al. |
| 4,953,641 | A | | 9/1990 | Pessier |
| 4,984,643 | A | | 1/1991 | Isbell et al. |
| 4,991,671 | A | | 2/1991 | Pearce et al. |
| 5,016,718 | A | | 5/1991 | Tandberg |
| 5,027,912 | A | | 7/1991 | Juergens |
| 5,028,177 | A | | 7/1991 | Meskin et al. |
| 5,030,276 | A | | 7/1991 | Sung et al. |
| 5,049,164 | A | | 9/1991 | Horton et al. |
| 5,116,568 | A | | 5/1992 | Sung et al. |
| 5,145,017 | A | | 9/1992 | Holster et al. |
| 5,176,212 | A | | 1/1993 | Tandberg |
| 5,224,560 | A | | 7/1993 | Fernandez |
| 5,238,074 | A | | 8/1993 | Tibbitts et al. |
| 5,287,936 | A | | 2/1994 | Grimes et al. |
| 5,289,889 | A | | 3/1994 | Gearhart et al. |
| 5,337,843 | A | | 8/1994 | Torgrimsen et al. |
| 5,346,026 | A | | 9/1994 | Pessier et al. |
| 5,429,200 | A | | 7/1995 | Blackman et al. |
| 5,439,068 | A | | 8/1995 | Huffstutler et al. |
| 5,452,771 | A | | 9/1995 | Blackman et al. |
| 5,467,836 | A | | 11/1995 | Grimes et al. |
| 5,513,715 | A | | 5/1996 | Dysart |
| 5,518,077 | A | | 5/1996 | Blackman et al. |
| 5,547,033 | A | | 8/1996 | Campos, Jr. |
| 5,553,681 | A | | 9/1996 | Huffstutler et al. |
| 5,558,170 | A | | 9/1996 | Thigpen et al. |
| 5,570,750 | A | | 11/1996 | Williams |
| 5,593,231 | A | | 1/1997 | Ippolito |
| 5,606,895 | A | | 3/1997 | Huffstutler |
| 5,624,002 | A | | 4/1997 | Huffstutler |
| 5,641,029 | A | | 6/1997 | Beaton et al. |
| 5,644,956 | A | | 7/1997 | Blackman et al. |
| 5,655,612 | A | | 8/1997 | Grimes et al. |
| D384,084 | S | | 9/1997 | Huffstutler et al. |
| 5,695,018 | A | | 12/1997 | Pessier et al. |
| 5,695,019 | A | | 12/1997 | Shamburger, Jr. |
| 5,755,297 | A | | 5/1998 | Young et al. |
| 5,862,871 | A | * | 1/1999 | Curlett ..... 175/340 |
| 5,868,502 | A | | 2/1999 | Cariveau et al. |
| 5,873,422 | A | | 2/1999 | Hansen et al. |
| 5,941,322 | A | | 8/1999 | Stephenson et al. |
| 5,944,125 | A | | 8/1999 | Byrd |
| 5,967,246 | A | | 10/1999 | Caraway et al. |
| 5,979,576 | A | | 11/1999 | Hansen et al. |
| 5,988,303 | A | | 11/1999 | Arfele |
| 5,992,542 | A | | 11/1999 | Rives |
| 5,996,713 | A | | 12/1999 | Pessier et al. |
| 6,092,613 | A | | 7/2000 | Caraway et al. |
| 6,095,265 | A | | 8/2000 | Alsup |
| 6,109,375 | A | | 8/2000 | Tso |
| 6,173,797 | B1 | | 1/2001 | Dykstra et al. |
| 6,220,374 | B1 | | 4/2001 | Crawford |
| 6,260,635 | B1 | | 7/2001 | Crawford |
| 6,279,671 | B1 | | 8/2001 | Panigrahi et al. |
| 6,283,233 | B1 | | 9/2001 | Lamine et al. |
| 6,296,069 | B1 | | 10/2001 | Lamine et al. |
| RE37,450 | E | | 11/2001 | Deken et al. |
| 6,360,831 | B1 | | 3/2002 | Akesson et al. |
| 6,386,302 | B1 | | 5/2002 | Beaton |
| 6,401,844 | B1 | | 6/2002 | Doster et al. |
| 6,408,958 | B1 | | 6/2002 | Isbell et al. |
| 6,415,687 | B2 | | 7/2002 | Saxman |
| 6,439,326 | B1 | | 8/2002 | Huang et al. |
| 6,446,739 | B1 | | 9/2002 | Richman et al. |
| 6,450,270 | B1 | | 9/2002 | Saxton |
| 6,474,424 | B1 | | 11/2002 | Saxman |
| 6,510,906 | B1 | | 1/2003 | Richert et al. |
| 6,510,909 | B2 | | 1/2003 | Portwood et al. |
| 6,527,066 | B1 | | 3/2003 | Rives |
| 6,533,051 | B1 | | 3/2003 | Singh et al. |
| 6,544,308 | B2 | | 4/2003 | Griffin et al. |
| 6,562,462 | B2 | | 5/2003 | Griffin et al. |
| 6,568,490 | B1 | | 5/2003 | Tso et al. |
| 6,585,064 | B2 | | 7/2003 | Griffin et al. |
| 6,589,640 | B2 | | 7/2003 | Griffin et al. |
| 6,592,985 | B2 | | 7/2003 | Griffin et al. |
| 6,601,661 | B2 | | 8/2003 | Baker et al. |
| 6,601,662 | B2 | | 8/2003 | Matthias et al. |
| 6,684,967 | B2 | | 2/2004 | Mensa-Wilmot et al. |
| 6,729,418 | B2 | | 5/2004 | Slaughter, Jr. et al. |
| 6,739,214 | B2 | | 5/2004 | Griffin et al. |
| 6,742,607 | B2 | | 6/2004 | Beaton |
| 6,749,033 | B2 | | 6/2004 | Griffin et al. |
| 6,797,326 | B2 | | 9/2004 | Griffin et al. |
| 6,843,333 | B2 | | 1/2005 | Richert et al. |
| 6,861,098 | B2 | | 3/2005 | Griffin et al. |
| 6,861,137 | B2 | | 3/2005 | Griffin et al. |
| 6,878,447 | B2 | | 4/2005 | Griffin et al. |
| 6,883,623 | B2 | | 4/2005 | McCormick et al. |
| 6,986,395 | B2 | | 1/2006 | Chen |
| 6,988,569 | B2 | | 1/2006 | Lockstedt et al. |
| 7,096,978 | B2 | | 8/2006 | Dykstra et al. |
| 7,111,694 | B2 | | 9/2006 | Beaton |
| 7,137,460 | B2 | | 11/2006 | Slaughter, Jr. et al. |
| 7,152,702 | B1 | | 12/2006 | Bhome et al. |
| 7,234,550 | B2 | | 6/2007 | Azar et al. |
| 7,350,568 | B2 | | 4/2008 | Mandal et al. |
| 7,350,601 | B2 | | 4/2008 | Belnap et al. |
| 7,360,612 | B2 | | 4/2008 | Chen et al. |
| 7,377,341 | B2 | | 5/2008 | Middlemiss et al. |
| 7,387,177 | B2 | | 6/2008 | Zahradnik et al. |
| 7,392,862 | B2 | | 7/2008 | Zahradnik et al. |
| 7,398,837 | B2 | | 7/2008 | Hall et al. |
| 7,416,036 | B2 | | 8/2008 | Forstner et al. |
| 7,435,478 | B2 | | 10/2008 | Keshavan |
| 7,462,003 | B2 | | 12/2008 | Middlemiss |
| 7,473,287 | B2 | | 1/2009 | Belnap et al. |
| 7,493,973 | B2 | | 2/2009 | Keshavan et al. |
| 7,517,589 | B2 | | 4/2009 | Eyre |
| 7,533,740 | B2 | | 5/2009 | Zhang et al. |
| 7,568,534 | B2 | | 8/2009 | Griffin et al. |
| 2005/0087370 | A1 | | 4/2005 | Ledgerwood, III et al. |
| 2005/0178587 | A1 | | 8/2005 | Witman, IV et al. |
| 2005/0183892 | A1 | | 8/2005 | Oldham et al. |
| 2005/0263328 | A1 | | 12/2005 | Middlemiss |
| 2005/0273301 | A1 | | 12/2005 | Huang |
| 2006/0032674 | A1 | | 2/2006 | Chen et al. |
| 2006/0032677 | A1 | | 2/2006 | Azar et al. |
| 2006/0162969 | A1 | | 7/2006 | Belnap et al. |
| 2006/0196699 | A1 | | 9/2006 | Estes et al. |
| 2006/0254830 | A1 | | 11/2006 | Radtke |
| 2006/0266558 | A1 | | 11/2006 | Middlemiss et al. |
| 2006/0266559 | A1 | | 11/2006 | Keshavan et al. |
| 2006/0278442 | A1 | | 12/2006 | Kristensen |

| | | | |
|---|---|---|---|
| 2006/0283640 | A1 | 12/2006 | Estes et al. |
| 2007/0029114 | A1 | 2/2007 | Middlemiss |
| 2007/0062736 | A1 | 3/2007 | Cariveau et al. |
| 2007/0079994 | A1 | 4/2007 | Middlemiss |
| 2007/0187155 | A1 | 8/2007 | Middlemiss |
| 2008/0066970 | A1 | 3/2008 | Zahradnik et al. |
| 2008/0264695 | A1 | 10/2008 | Zahradnik et al. |
| 2008/0296068 | A1 | 12/2008 | Zahradnik et al. |
| 2009/0114454 | A1 | 5/2009 | Belnap et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0183925 | A1 | 7/2009 | Zhang et al. |

FOREIGN PATENT DOCUMENTS

| | | | |
|---|---|---|---|
| EP | 0157278 | | 11/1989 |
| EP | 0391683 | | 1/1996 |
| EP | 2089187 | | 8/2009 |
| GB | 2183694 | | 6/1987 |
| WO | 8502223 | | 5/1985 |
| WO | 8502223 | A1 | 5/1985 |
| WO | 2008124572 | | 10/2008 |

OTHER PUBLICATIONS

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins-New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

Ersoy, A. and Waller, M. "Wear characteristics of PDC pin and hybrid core bits in rock drilling." Wear 188, Elsevier Science S.A., Mar. 1995, pp. 150-165.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.

B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPC Annual Technical Conference and Exhibition, Denver, Colorado, Sep. 21-24, 2008.

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

* cited by examiner

DYNAMICALLY STABLE HYBRID DRILL BIT

BACKGROUND OF THE INVENTION

1. Technical Field

The present invention relates in general to earth-boring drill bits and, in particular, to a bit having a combination of rolling and fixed cutters and cutting elements.

2. Description of the Related Art

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field, near Beaumont, Tex. with relative ease. That venerable invention, within the first decade of the last century, could drill a scant fraction of the depth and speed of the modern rotary rock bit. The original Hughes bit drilled for hours, the modern bit drills for days. Modern bits sometimes drill for thousands of feet instead of merely a few feet. Many advances have contributed to the impressive improvements in rotary rock bits.

In drilling boreholes in earthen formations using rolling-cone or rolling-cutter bits, rock bits having one, two, or three rolling cutters rotatably mounted thereon are employed. The bit is secured to the lower end of a drillstring that is rotated from the surface or by a downhole motor or turbine. The cutters mounted on the bit roll and slide upon the bottom of the borehole as the drillstring is rotated, thereby engaging and disintegrating the formation material to be removed. The rolling cutters are provided with cutting elements or teeth that are forced to penetrate and gouge the bottom of the borehole by weight from the drilistring. The cuttings from the bottom and sides of the borehole are washed away by drilling fluid that is pumped down from the surface through the hollow, rotating drillstring, and are carried in suspension in the drilling fluid to the surface.

Rolling cutter bits dominated petroleum drilling for the greater part of the 20th century. With improvements in synthetic diamond technology that occurred in the 1970s and 1980s, the fixed-cutter, or "drag" bit became popular again in the latter part of the 20th century. Modern fixed-cutter bits are often referred to as "diamond" or "PDC" (polycrystalline diamond compact) bits and are far removed from the original fixed-cutter bits of the 19th and early 20th centuries. Diamond or PDC bits carry cutting elements comprising polycrystalline diamond compact layers or "tables" formed on and bonded to a supporting substrate, conventionally of cemented tungsten carbide, the cutting elements being arranged in selected locations on blades or other structures on the bit body with the diamond tables facing generally in the direction of bit rotation. Diamond bits have the advantage of being much more aggressive and therefore drill much faster at equivalent weight-on-bit (WOB). In addition they have no moving parts, which makes their design less complex and more robust. The drilling mechanics and dynamics of diamond bits are different from those of rolling-cutter bits precisely because they are more aggressive and generate more torque. During drilling operation, diamond bits are used in a manner similar to that for rolling cutter bits, the diamond bits also being rotated against a formation being drilled under applied weight on bit to remove formation material. The diamond cutting elements are continuously engaged as they scrape material from the formation, while the rolling-cutter cutting elements indent the formation intermittently with little or no relative motion (scraping) between the cutting element and formation. Rolling-cutter and diamond bits each have particular applications for which they are more suitable than the other; neither type of bit is likely to completely supplant the other in the foreseeable future.

In the prior art, some earth-boring bits use a combination of one or more rolling cutters and one or more fixed blades. Some of these combination-type drill bits are referred to as hybrid bits. Previous designs of hybrid bits, such as is described in U.S. Pat. No. 4,343,371, to Baker, III, and U.S. Pat. No. 4,444,281 to Schumacher have equal numbers of fixed blades and rolling cutter in essentially symmetrical arrangements. In these bits, the rolling cutters to do most of the formation cutting, especially in the center of the hole or bit.

At light WOB and higher RPM, fixed-cutter or drag bits sometimes suffer from an undesirable condition known as bit whirl. In this condition, the bit rotates temporarily about an axis that does not coincide with the geometric center of the bit in such a way that the bit tends to wobble or "backwards whirl" about the borehole. Thus, individual PDC cutting elements travel sideways and backwards and are subject to high loads in a direction for which they are not designed. This can cause breakage and premature destruction of the cutting elements. Various means and methods have been devised to combat this condition in what are typically called "anti-whirl" bits. Examples of anti-whirl bits are found in commonly assigned U.S. Pat. Nos. 5,873,422 and 5,979,576 to Hansen et al. and also in U.S. Pat. No. 4,932,484, to Warren, et al., assigned to Amoco.

In rolling-cutter bits, a similar condition called "off-center running" or forward whirl occurs when the bit axis itself rotates in a concentric circle around the center of the borehole. This is typical in drilling applications in which the material being drilled is behaving plastically and lateral movement of the bit is facilitated due to lack of stabilization, light depth of cut, high RPM, and low weight on bit. Another factor encouraging off-center running of the bit is inadequate bottom hole cleaning, which leaves a layer of fine cuttings on the borehole bottom, which acts as a lubricant between the bit and the formation to make lateral displacement of the bit easier. Off-center running is not nearly as destructive to the cutting elements or cutting structure of the rolling-cutter bit as whirl is to the fixed-cutter bit. Off-center running in rolling cutter bits is still undesirable because the bit drills slowly and creates an oversize or out-of-gage borehole in which the bit is harder to stabilize and tends to "walk" so that the borehole deviates from vertical in undesirable ways. An example of a rolling-cutter design that addresses off-center running are found in commonly assigned U.S. Pat. No. 5,695,018 to Pessier and Isbell.

None of the prior art addresses the dynamic, "whirling" tendencies of the hybrid bit with its combination of rolling cutters and fixed blades. Accordingly, an improved hybrid earth-boring bit with enhanced drilling performance would be desirable.

SUMMARY OF THE INVENTION

It is a general object of the present invention to provide an improved dynamically stable earth-boring bit of the hybrid variety. This and other objects of the present invention are achieved by providing an earth-boring bit comprising a bit body configured at its upper extent for connection into a drilistring. A selected number of fixed blades extend downward from the bit body and a selected number of rolling cutters are mounted for rotation on the bit body. A plurality of rolling-cutter cutting elements may be arranged on each rolling cutter and a plurality of fixed-blade cutting elements are arranged on each fixed blade. The selected number of fixed blades exceeds the selected number of rolling cutters by at least one.

According to an illustrative embodiment of the present invention, the fixed blades and rolling cutters are distributed around 360 degrees of circumference of the bit body and the majority of the fixed-blade cutting elements are contained within 180 degrees of the circumference of the bit body.

According to an illustrative embodiment of the present invention, at least one of the fixed-cutter cutting elements is located proximal the central axis of the bit body to disintegrate formation at the axial center. But, a center-cutting fixed-cutter cutting element is not necessary according to the present invention.

According to an illustrative embodiment of the present invention, ⅔ of the fixed-blade cutting elements are contained within 180 degrees of the circumference of the bit body.

According to an illustrative embodiment of the present invention, at least two of the selected number of fixed blades are adjacent one another without an intervening rolling cutter.

Other objects, features and advantages of the present invention will become apparent with reference to the figures and detailed description.

BRIEF DESCRIPTION OF THE DRAWINGS

So that the manner in which the features and advantages of the present invention, which will become apparent, are attained and can be understood in more detail, more particular description of embodiments of the invention as briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
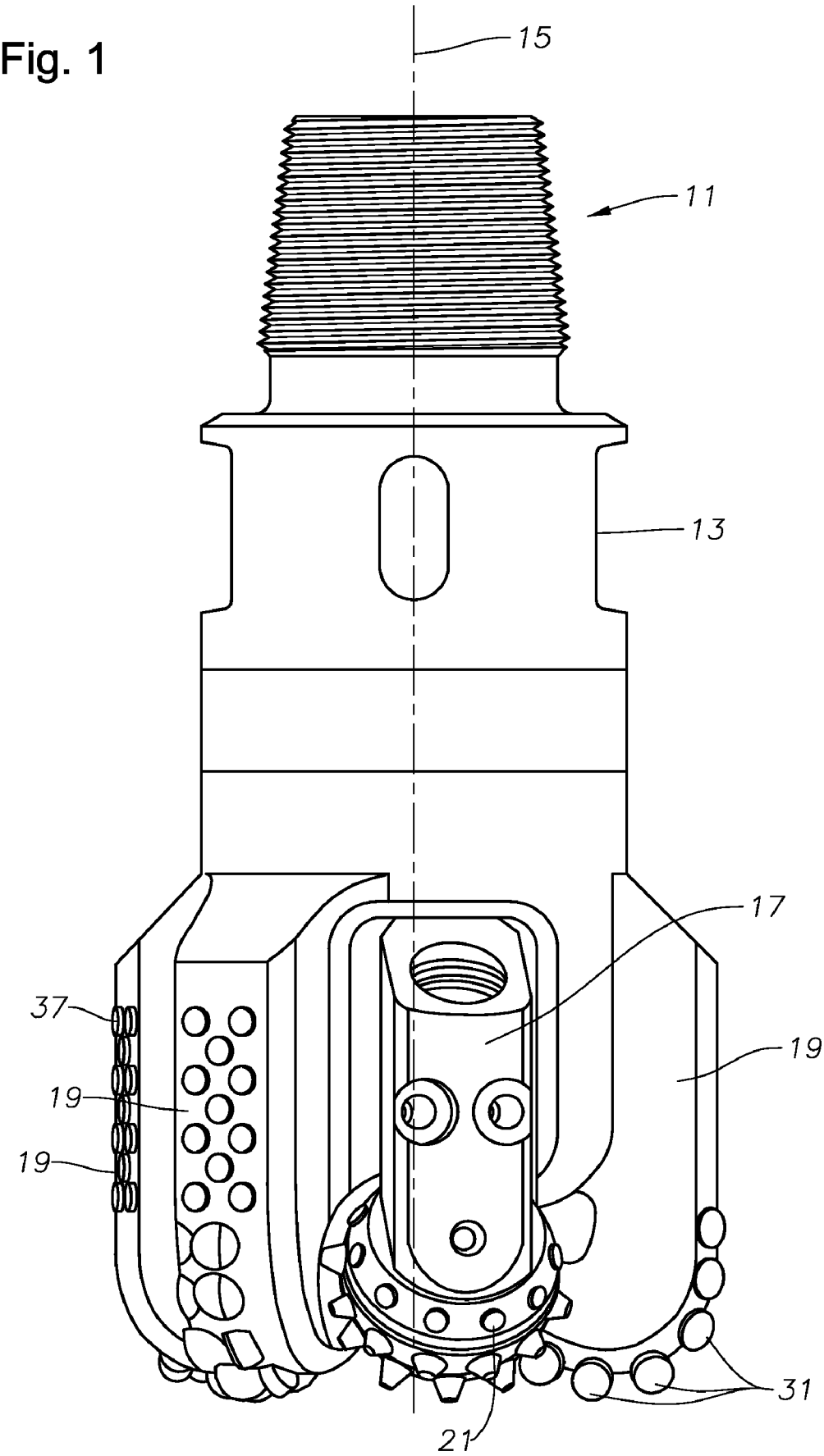
FIG. 1 is an elevation view of the hybrid earth-boring bit according to the preferred embodiment of the present invention.
Figure 2:
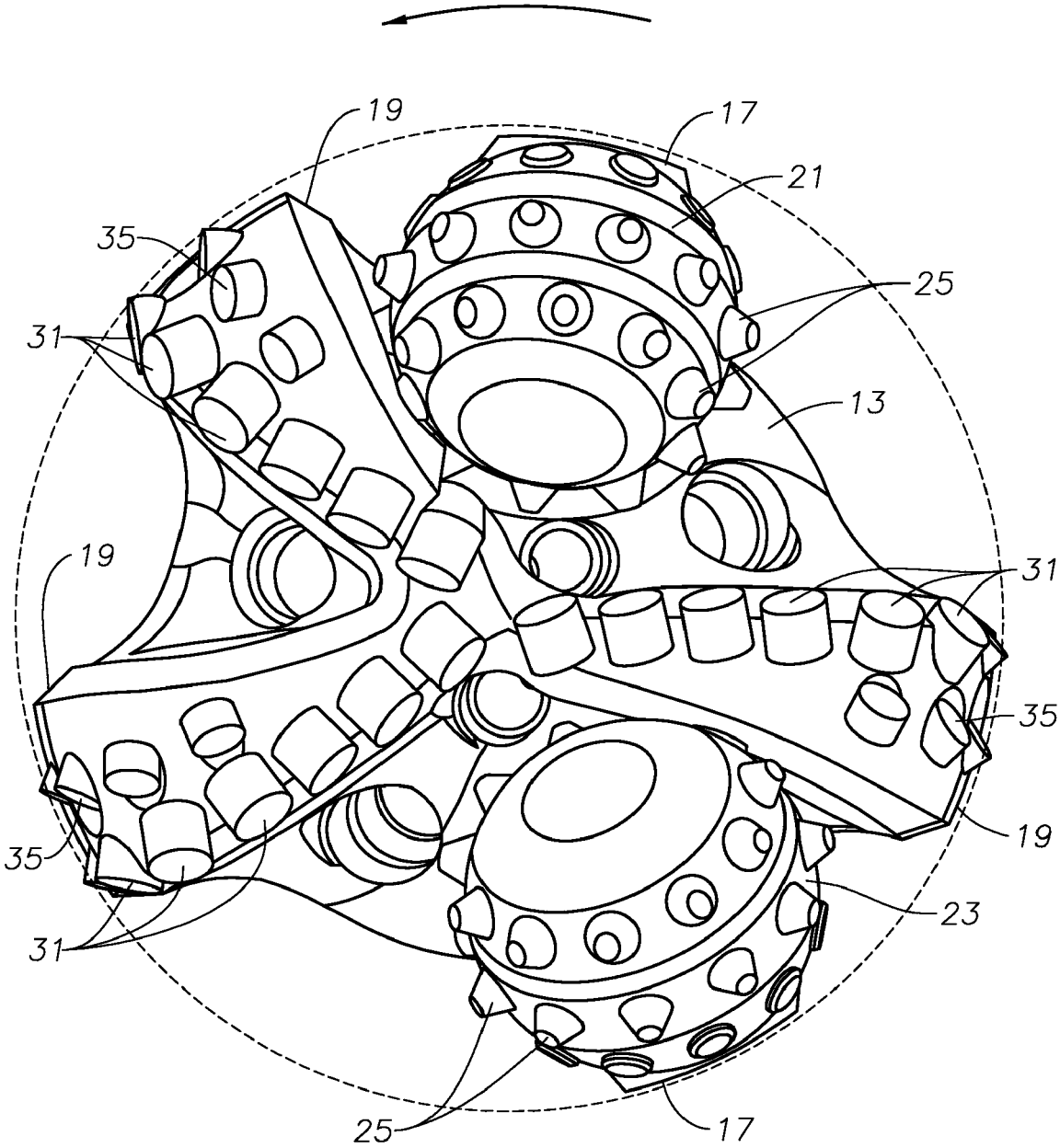
FIG. 2 is a bottom plan view of the embodiment of the hybrid earth-boring bit of FIG. 1.

Referring to FIGS. 1 and 2, an earth-boring bit 11 according to a preferred embodiment of the present invention is disclosed. Bit 11 comprises a bit body 13 having a central longitudinal axis 15 that defines an axial center of the bit body 13. In the illustrated embodiment, the bit body 13 is steel, but could also be formed of matrix material with steel reinforcements, or of a sintered carbide material. Bit body 13 includes a shank at the upper or trailing end thereof that is threaded or otherwise configured for attachment to a hollow drillstring (not shown), which rotates bit 11 and provides pressurized drilling fluid to the bit and the formation being drilled.

The radially outermost surface of the bit body 13 is known as the gage surface and corresponds to the gage or diameter of the borehole (shown in phantom in FIG. 2) drilled by bit 11. At least one (two are shown) bit leg 17 extends downwardly from the bit body 13 in the axial direction. The bit body 13 also has a plurality (e.g., three shown) of fixed blades 19 that extend downwardly in the axial direction. The bit legs 17 and fixed blades 19 are distributed about the 360 degree circumference of the bit body in specified locations. As discussed in greater detail below, the number and location of the fixed blades 19 (and the number of fixed cutters thereon), plays an important role in the stabilizing or anti-whirl aspects of the bit constructed in accordance with the present invention.

Figure 3:
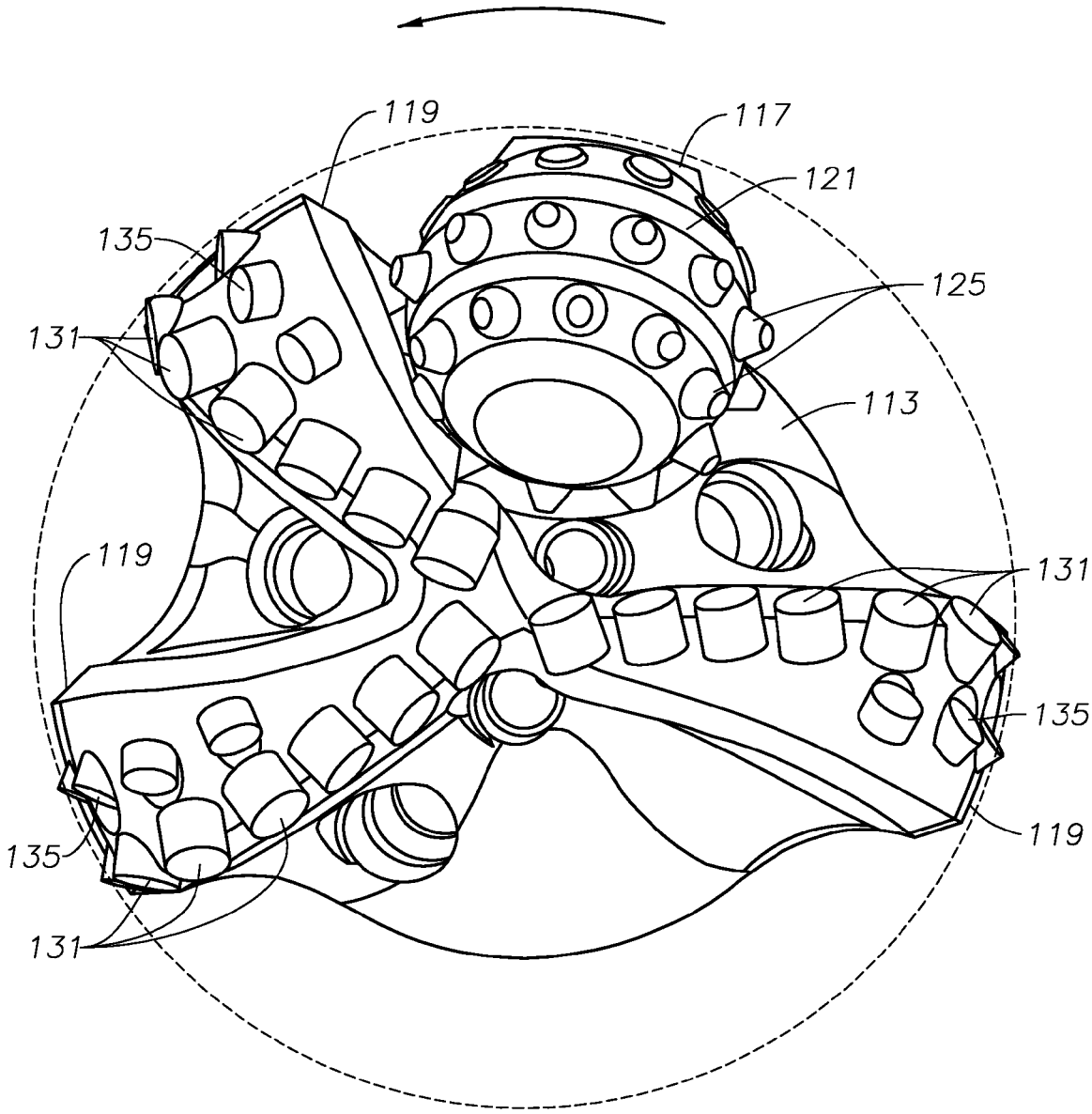
FIG. 3 is a bottom plan view of another illustrative embodiment of the hybrid earth-boring bit constructed in accordance with the present invention.

A rolling cutter 21, 23 is mounted on a sealed journal bearing that is part of each bit leg 17. Sealed or unsealed rolling-element bearings may be employed instead of the sealed journal bearing. According to the illustrated embodiment, the rotational axis of each rolling cutter 21, 23 intersects the axial center 15 of the bit, and therefore rolling cutters 21 have no skew or angle and no offset (FIGS. 2 and 3). Alternatively, the rolling cutters 21, 23 may be provided with skew angle and (or) offset to induce sliding of the rolling cutters 21, 23 as they roll over the borehole bottom.

At least one (a plurality are illustrated) rolling-cutter cutting inserts or elements 25 are arranged on the rolling cutters 21, 23 in generally circumferential rows. Rolling-cutter cutting elements 25 need not be arranged in rows, but instead could be "randomly" placed on each rolling cutter 21, 23. Moreover, the rolling-cutter cutting elements may take the form of one or more discs or "kerf-rings," which would also fall within the meaning of the term rolling-cutter cutting elements. Rolling cutters 21, 23, in combination with fixed blades 19, reduce vibration at constant weight-on-bit compared to fixed-cutter bits. Further, the rolling cutter or cutters 21, 23 serve to limit the depth-of-cut of the cutting elements on the fixed blades 19. These purposes can also be accomplished with rolling cutters that are entirely devoid of rolling-cutter cutting elements 25, whether inserts, or teeth or other elements.

Tungsten carbide inserts, secured by interference fit (or brazing) into bores in the rolling cutter 21, 23 are shown, but a milled- or steel-tooth cutter having hardfaced cutting elements (25) integrally formed with and protruding from the rolling cutter could be used in certain applications and the term "rolling-cutter cutting elements" as used herein encompasses such teeth. The inserts or cutting elements may be chisel-shaped as shown, conical, round, or ovoid, or other shapes and combinations of shapes depending upon the application. Rolling cutter cutting elements 25 may also be formed of, or coated with, superabrasive or super-hard materials such as polycrystalline diamond, cubic boron nitride, and the like.

In addition, a plurality of fixed-blade or fixed cutting elements 31 are arranged in a row and secured to each of the fixed blades 19 at the leading edges thereof (leading being defined in the direction of rotation of bit 11). Each of the fixed-blade cutting elements 31 comprises a polycrystalline diamond layer or table on a rotationally leading face of a supporting substrate, the diamond layer or table providing a cutting face having a cutting edge at a periphery thereof for engaging the formation.

A plurality of back-up cutters 35 are present on each blade 19. Back-up cutters 35 are optional and serve primarily to protect blades 19 against wear on surfaces behind the leading edge of each blade. Back-up cutters can also have influence on the stability and dynamics of a bit 11, but the effect is minimal in comparison to the primary fixed cutting elements 31 on the leading edge of each blade 19. Thus, for purposes of this application, back-up cutters 35, or any other fixed cutters or cutting elements not present on the leading edge of each blade, are not "counted" for purposes of inducing a lateral imbalance force to resist the backward whirl tendency of the bit, as discussed in greater detail below.

A plurality of wear-resistant elements 37 are present on the gage surface at the outermost periphery of each blade 19 (FIG. 1). These elements 37 may be flat-topped or round-topped tungsten-carbide or other hard-metal inserts interference fit or brazed into apertures on the gage pads of each blade 19. The primary function of these elements 37 is passive and is to resist wear of the blade 19. In some applications, it may be desirable to place active cutting elements on the gage pad, such as super-hard (polycrystalline diamond) flat-topped elements with a beveled edge for shear-cutting the sidewall of the borehole being drilled. In other applications, it may be beneficial to apply hardfacing with welded hardmetal, such as tungsten carbide.

The number of bit legs 17 and fixed blades 19 is at least one, and according to one embodiment of the invention, the number of fixed blades exceeds the number of bit legs 17 (and the associated rolling cutters) by at least one. Typically, if there are more blades 19 than rolling cutters 21, 23 (and more than one of each), the distribution of the blades requires that at least two of the blades 19 and their associated fixed cutting elements 31 be distributed on one half or within 180 degrees of the circumference of the bit. Regardless, according to the present invention, the number and distribution (about the 360 degree circumference of bit body 13) of fixed blades 19 (and of fixed cutting elements 31) is selected so that the fixed cutting elements 31 are concentrated in one area of the bit. This induces a lateral imbalance force in the bit during drilling operation and tends to resist the tendency of the bit to backward whirl, thus avoiding the destructive forces to or on fixed cutting elements 31 associated with this condition. Further, the presence of the rolling cutters tends to introduce off-center running or forward whirl, which also counteracts the tendency toward destructive backward whirl.

Specifically, in accordance with the present invention, the number and distribution of fixed blades 19 is selected such that at least a majority (more than half and preferably closer to two-thirds (⅔) of the fixed cutting elements 31 on the fixed blades are concentrated on one half or 180 degree section of the circumference of bit 11. Further, the asymmetry in blade and cutter arrangement and the imbalance in cutting forces can be enhanced if the number of fixed blades 19 (and associated cutting elements 31) exceeds the number of rolling cutters 21, 23. Furthermore, the greater number of fixed blade 19 allows for a greater number and redundancy of fixed cutting elements 31. This reduces the unit load on each cutting element 31 and thus improves their durability and service life.

In accordance with these parameters, the preferred embodiment illustrated in FIGS. 1 and 2 has three fixed blades 19 and two (one less) bit legs 17 and rolling cutters 21, 23. Two of the fixed blades 19 are relatively close together (approximately 70 degrees) and have no bit leg or rolling cutter between them. The third fixed blade 19 is spaced approximately 140 degrees from each of the other two fixed blades. Each fixed blade 19 has eight or nine fixed cutting elements 31, so that there are a total of between 24 and 27 total fixed cutting elements 31. Accordingly, in the preferred embodiment illustrated in FIGS. 1 and 2, between 16 and 19 fixed cutters (out of 24 to 27 total), are located within one-half or 180 degrees of the circumference of the bit 11. Again, back-up cutters 35 or any other cutters not on the leading edge of the blades 19 are not counted for purposes of this calculation.

FIG. 3 illustrates yet another embodiment of a bit 111 according to the present invention that is highly asymmetrical by having the number of blades 119 (three) exceed the number of legs 117 and cutter 121 (one) by two. Thus, two of the three blades 119 and the associated majority (approximately ⅔) fixed cutting elements 131 are within 180 degrees of the circumference. In this embodiment, all of the fixed blades 119 are angularly spaced apart and contained within approximately 220 degrees, two of them without an intervening leg 117 and cutter 121. This embodiment relies on both angular spacing of the blades 119 and a larger number of blades (relative to cutters) to induce asymmetry and the resulting imbalance force.

According to the illustrated embodiments, at least one of the fixed cutting elements 31 on at least one of the blades is located to cut at the axial center of the bit (typically coinciding with the axial center of the borehole). However, the dynamic stability of the configuration is not dependent upon cutting at the center of the borehole with a fixed cutting element 31 and this configuration is illustrative only. In any event, due to the hybrid configuration of the bit, the rolling cutter cutting elements 25, 125 and the fixed-blade cutting elements 31, 131 combine to define a common or congruent cutting surface in the nose and shoulder portions of the bit profile. The rolling-cutter cutting elements 25, 125 crush and pre-fracture formation in the highly stressed nose and shoulder sections of the borehole, easing the burden on fixed cutting elements 31, 131.

Further, the asymmetry introduced by confining the majority of the fixed blades 19, 119 and associated fixed cutting elements 31, 131 on one-half (180 degrees) or less of the circumference of the bit, which can be combined with the unequal number of fixed blades 19, 119 and rolling cutters 21, 23, 121, provide an imbalance force that cooperates with the tendency toward forward whirl of the rolling cutters 21, 23, 121 to counteract the tendency of the bit to backward whirl and the associated destruction or damage to fixed cutting elements 31, 131.

The invention has several advantages and includes asymmetry of blades and rolling cutters and an imbalance of the cutting forces, which tends to avoid or suppress synchronous vibration and destructive backward whirl. The greater number of blades further improves the durability of the dominant PDC cutting structure with greater cutting element density and redundancy.

While the invention has been shown or described in only some of its forms, it should be apparent to those skilled in the art that it is not so limited, but is susceptible to various changes without departing from the scope of the invention as hereinafter claimed, and legal equivalents thereof.

We claim:

1. An earth-boring bit comprising:

a bit body having a central longitudinal axis that defines the axial center of the bit body and configured at its upper end for connection to a drillstring;

a selected number of fixed blades extending downward from the bit in the axial direction;

a selected number of rolling cutters mounted for rotation on the bit body; and a plurality of fixed-blade cutting elements arranged on each fixed blade;

wherein the fixed blades and the rolling cutters are arranged asymmetrically, and the selected number of fixed blades exceeds the selected number of rolling cutters by at least one, and wherein at least one of the fixed-blade cutting elements on at least one of the fixed blades is located to cut at the axial center of the bit.

2. The earth-boring bit of claim 1, wherein the fixed blades and rolling cutters are distributed around 360 degrees of circumference of the bit body and the majority of the fixed-blade cutting elements on a rotationally leading edge of each blade are contained within 180 degrees of the circumference of the bit body.

3. The earth-boring bit of claim 2, wherein ⅔ of the fixed-blade cutting elements are contained within 180 degrees of the circumference of the bit body.

4. The earth-boring bit of claim 1, further comprising:

a plurality of rolling-cutter cutting elements arranged on each rolling cutter.

5. The earth-boring bit of claim 4, wherein the fixed-blade cutting elements and the rolling-cutter cutting elements combine during drilling operation to define a congruent cutting surface in nose and shoulder sections of the borehole being drilled.

6. An earth-boring bit comprising:

a bit body having a central longitudinal axis that defines the axial center of the bit body and configured at its upper end for connection to a drillstring;

a plurality of fixed blades extending downward from the bit in the axial direction;

at least one rolling cutter mounted for rotation on the bit body; and a plurality of fixed-blade cutting elements arranged on a rotationally leading edge of each fixed blade;

wherein the fixed blades and rolling cutters are distributed asymmetrically around 360 degrees of circumference of the bit body, and the majority of the fixed-blade cutting elements are contained within 180 degrees of the circumference of the bit body, and wherein at least one of the fixed-blade cutting elements on at least one of the fixed blades is located to cut at the axial center of the bit.

7. The earth-boring bit of claim 6, wherein the selected number of fixed blades exceeds the selected number of rolling cutters by at least one.

8. The earth-boring bit of claim 6, further comprising:

a plurality of rolling-cutter cutting elements arranged on each rolling cutter.

9. The earth-boring bit of claim 6, wherein ⅔ of the fixed-blade cutting elements are contained within 180 degrees of the circumference of the bit body.

10. The earth-boring bit of claim 6, wherein at least two of the plurality of fixed blades are adjacent one another without an intervening rolling cutter.

11. The earth-boring bit of claim 6, wherein the fixed-blade cutting elements and the rolling-cutter cutting elements combine during drilling operation to define a congruent cutting surface in nose and shoulder sections of the borehole being drilled.

12. An earth-boring bit comprising:

a bit body having a central longitudinal axis that defines the axial center of the bit body and configured at its upper end for connection to a drillstring;

a plurality of fixed blades extending downward from the bit in the axial direction;

at least one rolling cutter mounted for rotation on the bit body, there being at least one more fixed blade than rolling cutter;

a plurality of rolling-cutter cutting elements arranged on each rolling cutter; and a plurality of fixed-blade cutting elements arranged on a rotationally leading edge of each fixed blade, wherein the fixed blades and rolling cutter are distributed asymmetrically around 360 degrees of circumference of the bit body, and the majority of the fixed-blade cutting elements are contained within 180 degrees of the circumference of the bit body, and wherein at least one of the fixed-blade cutting elements on at least one of the fixed blades is located to cut at the axial center of the bit.

13. The earth-boring bit of claim 12, wherein the selected number of fixed blades exceeds the selected number of rolling cutters by at least one.

14. The earth-boring bit of claim 12, wherein the fixed-blade cutting elements and the rolling-cutter cutting elements combine during drilling operation to define a congruent cutting surface.

15. The earth-boring bit of claim 12, wherein at least two of the plurality of fixed blades are adjacent one another without an intervening rolling cutter.

16. The earth-boring bit of claim 12, wherein ⅔ of the fixed-blade cutting elements are contained within 180 degrees of the circumference of the bit body.

17. An earth-boring bit comprising:

a bit body having a central longitudinal axis that defines the axial center of the bit body and configured at its upper end for connection to a drillstring;

a plurality of fixed blades extending downward from the bit in the axial direction;

at least one rolling cutter mounted for rotation on the bit body;

a plurality of fixed-blade cutting elements arranged on each fixed blade, wherein the fixed blades and rolling cutters are asymmetrically distributed around 360 degrees of circumference of the bit body, two of the fixed blades being adjacent one another at a spacing of about 70 degrees apart and with no intervening bit leg or rolling cutter between them, and wherein at least one of the fixed-blade cutting elements on at least one of the fixed blades is located to cut at the axial center of the bit.

18. The earth-boring bit of claim 17, wherein the number of fixed blades exceeds the number of rolling cutters by at least one.

19. The earth-boring bit of claim 17, further comprising:

a plurality of rolling-cutter cutting elements arranged on each rolling cutter.

20. The earth-boring bit of claim 17, wherein the fixed-blade cutting elements and the rolling-cutter cutting elements combine during drilling operation to define a congruent cutting surface.

21. The earth-boring bit of claim 17, wherein ⅔ of the fixed-blade cutting elements are contained within 180 degrees of the circumference of the bit body.

* * * * *